US006542441B2

(12) United States Patent
Terasawa

(10) Patent No.: US 6,542,441 B2
(45) Date of Patent: Apr. 1, 2003

(54) BATTERY COVER STRUCTURE

(75) Inventor: Dai Terasawa, Chiba (JP)

(73) Assignee: Seiko Instruments Inc. (JP)

( * ) Notice: Subject to any disclaimer, the term of this patent is extended or adjusted under 35 U.S.C. 154(b) by 229 days.

(21) Appl. No.: 09/732,964

(22) Filed: Dec. 8, 2000

(65) Prior Publication Data

US 2001/0006491 A1 Jul. 5, 2001

(30) Foreign Application Priority Data

Dec. 27, 1999 (JP) ..... 11-370610

(51) Int. Cl.[7] ..... G04B 1/00; G04B 37/00; G04C 3/00

(52) U.S. Cl. ..... 368/204; 368/309

(58) Field of Search ..... 368/88, 279, 281, 368/203, 204, 309

(56) References Cited

U.S. PATENT DOCUMENTS 4,182,020 A 1/1980 Molloy et al. ..... 29/469.5
4,232,512 A * 11/1980 Yoshikawa et al. ..... 368/276
4,250,573 A * 2/1981 Saito ..... 340/387.1
5,010,532 A 4/1991 Perott ..... 368/88

FOREIGN PATENT DOCUMENTS

CH 0531202 4/1972
GB 2178561 2/1987

* cited by examiner

*Primary Examiner*—Vit Miska
(74) *Attorney, Agent, or Firm*—Adams & Wilks

(57) ABSTRACT

A circular case battery hole is formed in the case back right below a battery accommodation hole, and in a portion of the outer surface around the battery hole is provided a battery cover detachment recess portion. A battery cover is formed of a disklike elastic sealing member having a large-diameter portion at its watch case interior side and a small-diameter portion at its outer side, and a disklike hard member made of a metal, a plastic, or the like joined to outer side of the elastic sealing member. The battery cover is attached to the case battery hole portion in such a manner that the small-diameter portion of the elastic sealing member has a horizontal fitting margin relative to the case battery hole. In the battery cover of this embodiment, the elastic sealing member has a fitting recess portion at its outer side while the hard member has an fitting projection portion at its internal side, and the elastic sealing member and the hard member are joined by projection-recess fitting.

12 Claims, 2 Drawing Sheets

BATTERY COVER STRUCTURE

BACKGROUND OF THE INVENTION

1. Field of the Invention

The present invention relates to a battery cover structure in a watchcase.

2. Description of the Prior Art

A battery cover structure in a watchcase, such as one disclosed in Japanese Utility Model Application Laid-Open No. Sho 62-55190, has been proposed. This battery cover structure is characterized in that a battery cover formed of an elastic sealing member is attached to a battery hole portion of the case in such a manner that its side wall recess portion has a horizontal fitting margin relative to the case battery hole.

The above described watch case battery cover structure entails problems described below.

(1) Since the battery cover is an elastic member, it can be bent into the inner side of the watchcase by hydraulic pressure to exert a bad influence upon the movement through the battery such as to stop the movement of the hand.

(2) Since the battery cover is an elastic member, the battery cover itself is deformed by hydraulic pressure to come off the battery hole portion.

(3) The battery cover is made of rubber or the like and therefore has a poor appearance.

(4) The battery cover and battery can easily be detached, so that there is a risk of allowing a little child to accidentally swallow the battery cover or battery.

(5) There is a risk of the battery cover and battery being lost by being removed by mishandling.

A first object of the present invention is to provide a battery cover structure in a watch case which is designed so as to solve the above-described problems of the above-described conventional watch case battery cover structure, which is free from the risk of bending the battery cover by hydraulic pressure to badly influence the movement, or deforming the battery cover itself by hydraulic pressure to cause the battery cover to come off the battery hole portion, and which has an improved appearance.

A second object of the present invention is to provide a battery cover structure in a watch case which is free from the risk of allowing the battery cover to be easily detached and accidentally swallowed by a little child or the like, or to be removed by mishandling to be lost.

SUMMARY OF THE INVENTION

According to one aspect of the present invention achieving the above-described first object, there is provided a battery cover structure in a watch case with a case back or an integral type watch case, in which a battery cover is attached to a case battery hole having a battery detachment recess portion formed by partially recessing an outer surface of the case back of the watch case or a bottom surface of the integral type watch case around the case battery hole, the battery cover structure comprising:

a disklike elastic sealing member having a large-diameter portion at its watch case interior side and a small-diameter portion at its outer side; and a disklike hard member joined to the elastic sealing member on the outer side of the same, characterized in that the battery cover is attached to the case battery hole portion in such a manner that the small-diameter portion of the elastic sealing member has a horizontal fitting margin relative to the case battery hole.

According to a second aspect of the present invention achieving the above-described first object, in the first aspect of the present invention, the watch case battery cover structure is characterized in that the elastic sealing member has a fitting recess portion at its outer side;

the hard member has a fitting projection at its inner side; and the elastic sealing member and the hard member are joined by projection-recess fitting.

According to a third aspect of the present invention achieving the above-described first object, in the first or second aspect of the present invention, the watch case battery cover structure is characterized in that the elastic sealing member and the hard member are joined by an adhesive.

According to a fourth aspect of the present invention achieving the above-described first and second objects, in the first, second or third aspect of the present invention, the watch case battery cover structure is characterized in that a slanted-surface portion or a stepped portion is formed in an edge portion of the hard member at the inner side; and a rectangular groove is formed in the outer surface of the hard member in a position corresponding to the position of the slanted-surface portion or the stepped portion.

According to a fifth aspect of the present invention achieving the above-described first and second objects, in the fourth aspect of the present invention, the watch case battery cover structure is characterized in that a mark indicating an opening or a closed position of the battery cover is provided on the outer surface of the case back and/or the outer surface of the hard member.

(Operation)

In the arrangement according to any one of the above-described first to third aspects, the outer side (back side) of the elastic sealing member is backed up with the hard member (rigid member) made of a metal, a plastic, or the like, and these members are integrally joined by projection-recess fitting or adhesion by an adhesive. Therefore, the battery cover is not bent or deformed by hydraulic pressure from the outer side of the case, so that the possibility of a bad influence upon the movement is eliminated and the battery cover itself does not come off. Also, the external appearance is improved because the outer side is formed by a metal, a plastic, or the like.

If the battery cover structure is arranged according to the above-described fourth aspect, functions described below are achieved as well as the above-described functions and effects.

That is, the battery cover can be freely rotated by inserting a portion of a coin or the like in the rectangular groove formed in the outer surface of the hard member. After the battery cover has been rotated so that the slanted-surface portion or the stepped portion provided in a portion of the edge of the hard member at the inner side, is brought to a position corresponding to the position of the battery detachment recess portion provided in a portion of the outer surface of the watch case case back around the battery hole, the battery cover can readily be detached by forcing the tip of a nail, a knife, or any other detachment jig to the slanted-surface portion or the stepped portion through the battery detachment recess. If the battery cover is rotated so that the slanted-surface portion or the stepped portion provided in a portion of the edge of an interior side of the hard member is not at a position corresponding to the position of the battery detachment recess portion provided in a portion around the battery hole of the watch case case back, the tip of a nail, a knife, or any other detachment jig cannot be forced to the slanted-surface portion or the stepped portion through the battery detachment recess. Thus, the battery cover is prevented from being easily detached and accidentally swallowed by a little child, or the battery cover or the battery is prevented from being detached and lost by mishandling.

If the battery cover structure is arranged according to the above-described fifth aspect, the rotation and positioning for opening and closing the battery cover may be performed reliably while the above-described functions are achieved.

And according to one aspect of the present invention achieving the above-described, a battery cover structure comprising: an elastic sealing member having a large-diameter portion at its watch case interior side and a small-diameter portion at its outer side; and a hard member joined to said elastic sealing member on the outer side of the same,characterized in that the battery cover is attached to the case battery hole portion in such a manner that the small-diameter portion of the elastic sealing member has a horizontal fitting margin relative to the case battery hole.

BRIEF DESCRIPTION OF THE DRAWINGS

A preferred form of the present invention is illustrated in the accompanying drawing in which:

FIG. 4A is a longitudinal sectional view of a battery hole portion and a battery cover of a case back of a watch case in this embodiment; and FIG. 4B is a bottom view viewed in the direction of arrow A in FIG. 4A;

FIG. 5A is a longitudinal sectional view of the battery hole portion and the battery cover of a case back of a watch case in this embodiment, and FIG. 5B is a bottom view viewed in the direction of arrow B in FIG. 5A.

DETAILED DESCRIPTION OF THE PREFERRED EMBODIMENTS

One embodiment of the watch case battery cover structure of the present invention will be described with reference to the accompanying drawings.

Figure 1:
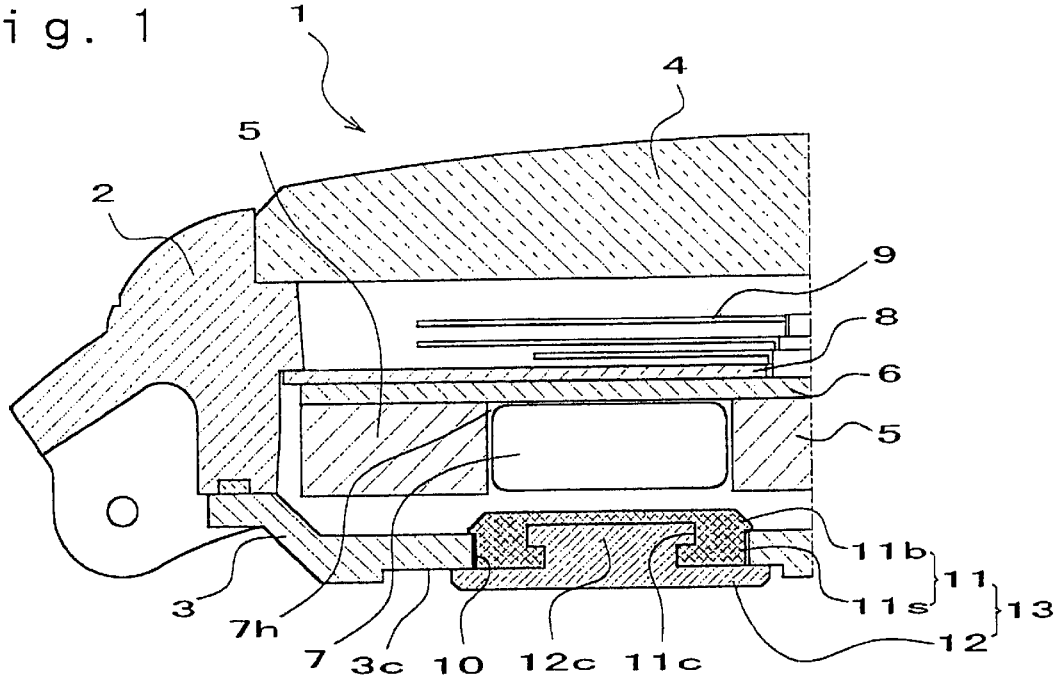
FIG. 1 is a cross-sectional view of essential portions of a first embodiment of the watch case battery cover structure of the present invention.

FIG. 1 is a cross-sectional view of essential portions of a first embodiment of the watch case battery cover structure of the present invention.

The watch case 1 according to this embodiment, as shown in FIG. 1, is constituted by a body 2 forming a peripheral portion, a case back 3 fixed to the lower end of the body 2, and glass 4 attached to the upper end of the body 2. A battery 7 is accommodated in a battery accommodation portion 7*h* surrounded by a main plate 5 and a secondary main plate 6 located above it in the case 1. A dial 8 is set on the secondary main plate, and hands 9*a* to 9*c* are rotatably accommodated in the space between the dial 8 and inner surface of the glass 4.

A circular case battery hole 10 is formed in the case back 3 right below the battery accommodation hole 7*h,* and a portion of the outer surface around the battery hole is provided with a battery cover detachment recess portion 3*c*. A battery cover 13 is formed of a disklike elastic sealing member 11 having a large-diameter portion 11*b* at its watch case 1 interior side and a small-diameter portion 11*s* at its outer side, and a disklike hard member 12 made of a metal, a plastic, or the like joined to outer side of the elastic sealing member 11. The battery cover 13 is attached to the case battery hole portion 10 in such a manner that the small-diameter portion 11*s* of the elastic sealing member 11 has a horizontal fitting margin relative to the case battery hole 10. In the battery cover 13 of this embodiment, the elastic sealing member 11 has a fitting recess portion 11*c* at its outer side while the hard member 12 has an inner fitting projection 12*c* at its inner side, and the elastic sealing member 11 and the hard member 12 are joined by projection-recess fitting.

In the thus-arranged embodiment, the outer side (back side) of the elastic sealing member 11 is backed up with the hard member (rigid member) 12 made of a metal, a plastic or the like, and further these members are integrally joined by projection-recess fitting. Therefore, the battery cover is not bent or deformed by hydraulic pressure from the outer side of the case, so that the possibility of a bad influence upon the movement is eliminated and the battery cover itself does not come off. Also, the external appearance is improved because the outer side is formed by a metal, a plastic, or the like.

A second embodiment of the watch case battery cover structure of the present invention will next be described with reference to the accompanying figure.

Figure 2:
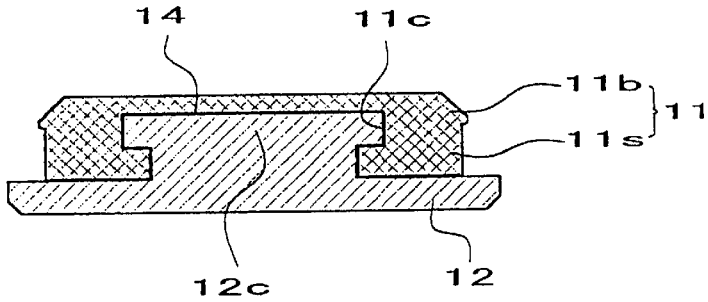
FIG. 2 is a longitudinal sectional view of a battery cover in the second embodiment of the present invention.

FIG. 2 is a longitudinal sectional view of a battery cover 13 in the second embodiment of the present invention.

The battery cover 13 shown in FIG. 2 is the same as that in the first embodiment described with reference to FIG. 1 except for the following point. That is, while in the first embodiment the elastic sealing member 11 and the hard member 12 are joined by projection-recess fitting, in this embodiment, the mating surfaces of the elastic sealing member 11 and the hard member 12 are further bonded to each other by an adhesive 14 to strengthen the joining.

The functions of this embodiment are the same as those of the above-described first embodiment.

A third embodiment of the watch case battery cover structure of the present invention will next be described with reference to the accompanying figure.

Figure 3:
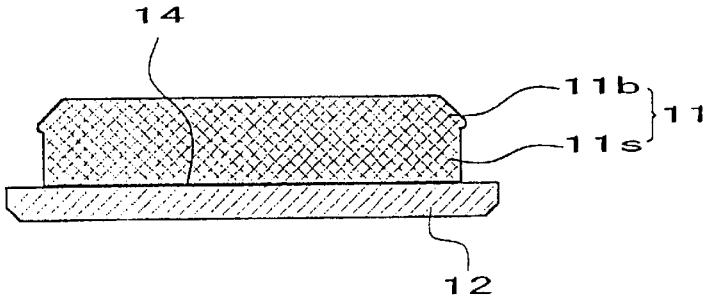
FIG. 3 is a longitudinal sectional view of a battery cover in the third embodiment of the present invention.

FIG. 3 is a longitudinal sectional view of a battery cover 13 in the second embodiment of the present invention.

The battery cover 13 shown in FIG. 3 is formed of a disklike elastic sealing member 11 having a large-diameter portion 11*b* at its watch case 1 interior side and a small-diameter portion 11*s* at its outer side, and a disklike hard member 12 made of a metal, a plastic, or the like, and joined to the outer side of the elastic sealing member 11. These two members are joined to each other by an adhesive 14.

The functions of this embodiment are the same as those of the above-described first embodiment.

A fourth embodiment of the watch case battery cover structure of the present invention will next be described with reference to the accompanying figures.

Figure 4A:
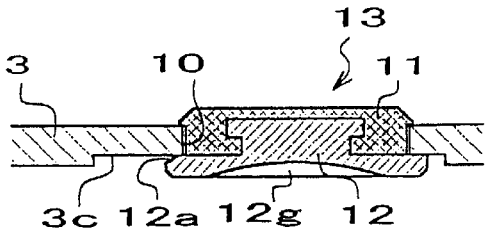
FIGS. 4A and 4B show a state where a battery cover in a fourth embodiment is in an "OPEN" position.
Figure 4B:
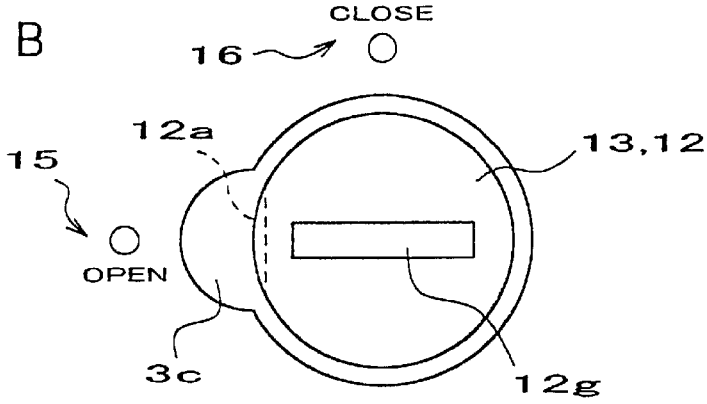

FIGS. 4A and 4B show a state where a battery cover 13 in this embodiment is in an "OPEN" position. FIG. 4A is a longitudinal sectional view of a battery hole portion of a case back 3 of the watch case and the battery cover 13 in this embodiment, and FIG. 4B is a bottom view viewed in the direction of arrow A in FIG. 4A.

Figure 5A:
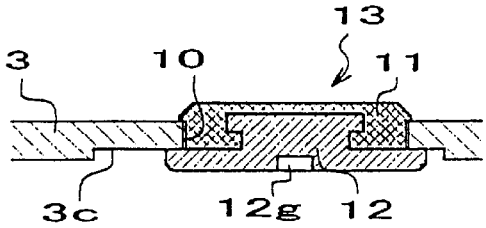
FIGS. 5A and 5B show a state where the battery cover in the fourth embodiment is in a "CLOSE" position in the present invention.
Figure 5B:
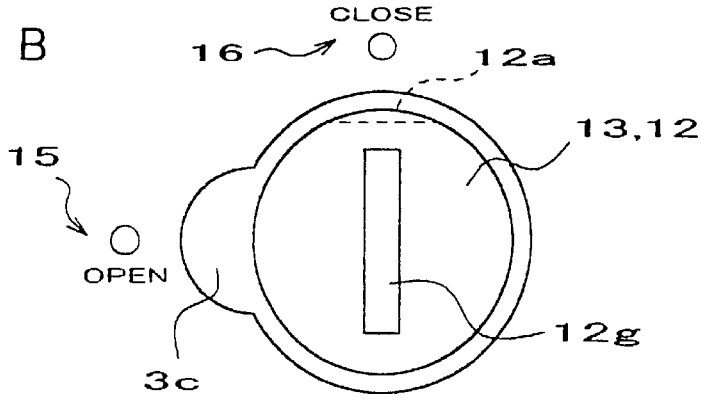

FIGS. 5A and 5B show a state where the battery cover 13 in this embodiment is in a "CLOSE" position. FIG. 5A is a longitudinal sectional view of the battery hole portion of the case back 3 of the watch case and the battery cover 13 in this embodiment, and FIG. 5B is a bottom view viewed in the direction of arrow B in FIG. 5A.

In this embodiment, the disklike hard member of the battery cover 13 in the first or second embodiment has a slanted surface formed in its peripheral edge portion at the watch interior side (at the upper side as viewed in FIGS. 4A and 5A); a rectangular groove 12*g* perpendicular to the slanted surface is formed in the hard member 12 at the outer side (bottom surface side); and marks "OPEN" and "CLOSE" 15 and 16 are provided in the outer surface of the case back 3 of the watch case.

The method of attaching and detaching the battery cover of the watch case in this embodiment and the functions of the battery cover will be described.

A. Attachment of Battery Cover 13

The battery cover 13 is positioned at the battery hole 10 in the case back 3 and is forced into the interior side by hand. The battery cover 13 is thereby forced thereinto until the upper surface peripheral portion of the hard member is brought into contact with the outer surface of the case back 3. In this state, the edges of a coin or the like are inserted in the rectangular groove 12*g* and operated to horizontally rotate the case back 13 until their direction coincide with the direction toward the position of the mark "CLOSE" 16, thereby bringing the slanted surface 12*a* to the position corresponding to the mark "CLOSE" 16 (see FIG. 5).

In this state, the battery cover 13 cannot be forced open by inserting the tip of a nail or a knife between the case back 3 and the upper surface of the hard member 12 through battery cover detachment recess portion 3*c* of the case back 3. Consequently, it is possible to prevent a little child from forcing the battery cover 13 open and accidentally swallowing the battery cover 13 or battery 7.

B. Detachment of Battery Cover 13

The edges of a coin or the like are inserted in the rectangular groove 13*g* of the outer surface of the battery cover 13 and operated to horizontally rotate the case back 13 until their direction coincide with the direction toward the position of the mark "OPEN" 15, thereby bringing the slanted surface 12*a* to the position corresponding to the mark "OPEN" 15 (see FIG. 4).

In this state, the battery cover 13 can be forced open by inserting the tip of a nail or a knife between the case back 3 and the upper surface of the hard member 12 through the battery detachment recess portion 3*c* of the case back 3. Consequently, there is no risk of allowing the battery cover 13 or the battery to be removed and lost by mishandling. The present invention has been described with respects to the embodiments thereof, but the present invention is not limited to the described embodiments.

For example, although a watch case with a case back has been described for explanation of the embodiments by way of example, the present invention can also be applied in exactly the same manner to integral type watch cases.

The fourth embodiment has been described with respect to an example of the formation of a slanted surface formed in a peripheral edge portion of the disklike hard member of the battery cover 13 at the watch interior side (at the upper side as viewed in FIGS. 4A and 5A). However, the shape is not limited to a slanted surface, and may be formed as a stepped shape to attain the same function.

The present invention has excellent effects as described below.

(1) According to the present invention, a battery cover structure in a watch case can be provided which is free from the risk of bending the battery cover by hydraulic pressure to badly influence the movement, or deforming the battery cover itself by hydraulic pressure to cause the battery cover to come off the battery hole portion, and which has an improved appearance.

(2) According to the present invention, a battery cover structure in a watch case can be provided which is free from the risk of allowing the battery cover to be easily detached and accidentally swallowed by a little child or the like, or to be removed and lost by mishandling.

What is claimed is:

1. A battery cover structure comprising:

an elastic sealing member having a large-diameter portion at its watch case interior side and a small-diameter portion at its outer side; and a hard member joined to said elastic sealing member on the outer side of the same, characterized in that the battery cover is attached to the case battery hole portion in such a manner that the small-diameter portion of the elastic sealing member has a horizontal fitting margin relative to the case battery hole.

2. A battery cover structure according to claim 1, characterized in that said elastic sealing member has a fitting recess portion at its outer side;

said hard member has a fitting projection portion at its inner side; and said elastic sealing member and said hard member are joined by projection recess fitting.

3. A battery cover structure according to claim 1, characterized in that said elastic sealing member and said hard member are joined by an adhesive.

4. A battery cover structure according to claim 2, characterized in that said elastic sealing member and said hard member are joined by an adhesive.

5. A battery cover structure according to claim 1, characterized in that a slanted-surface portion or a stepped portion is formed in an edge portion of said hard member at the inner side; and a rectangular groove is formed in the outer surface of said hard member in a position corresponding to the position of the slanted-surface portion or the stepped portion.

6. A battery cover structure according to claim 2, characterized in that a slanted-surface portion or a stepped portion is formed in an edge portion of said hard member at the inner side; and a rectangular groove is formed in the outer surface of said hard member in a position corresponding to the position of the slanted-surface portion or the stepped portion.

7. A battery cover structure according to claim 3, characterized in that a slanted-surface portion or a stepped portion is formed in an edge portion of said hard member at the inner side; and a rectangular groove is formed in the outer surface of said hard member in a position corresponding to the position of the slanted-surface portion or the stepped portion.

8. A battery cover structure according to claim 4, characterized in that a slanted-surface portion or a stepped portion is formed in an edge portion of said hard member at the inner side; and a rectangular groove is formed in the outer surface of said hard member in a position corresponding to the position of the slanted-surface portion or the stepped portion.

9. A battery cover structure according to claim 5, characterized in that a mark indicating an opening or a closed position of the battery cover is provided on the outer surface of the case back and/or the outer surface of the hard member.

10. A battery cover structure according to claim 6, characterized in that a mark indicating an opening or a closed position of the battery cover is provided on the outer surface of the case back and/or the outer surface of the hard member.

11. A battery cover structure according to claim 7, characterized in that a mark indicating an opening or a closed position of the battery cover is provided on the outer surface of the case back and/or the outer surface of the hard member.

12. A battery cover structure according to claim 8, characterized in that a mark indicating an opening or a closed position of the battery cover is provided on the outer surface of the case back and/or the outer surface of the hard member.

* * * * *